United States Patent [19]

Korte et al.

[11] 4,006,330

[45] Feb. 1, 1977

[54] CIRCUIT BREAKER ARC CHUTE HAVING COMPONENTS OF REFRACTORY INORGANIC MATERIAL WITH SURFACES OF AN AMORPHOUS FUSED MATERIAL, A MAJOR PROPORTION OF WHICH IS SILICA, AND METHOD FOR MAKING SAME

[75] Inventors: Richard M. Korte, West Chester, Pa.; John E. Zlupko, Marlton, N.J.

[73] Assignee: General Electric Company, Philadelphia, Pa.

[22] Filed: Apr. 16, 1975

[21] Appl. No.: 568,544

[52] U.S. Cl. ..... 200/144 C; 200/149 A

[51] Int. Cl.[2] ..... H01H 33/08

[58] Field of Search ..... 200/144 C, 144 R, 149 A

[56] References Cited

UNITED STATES PATENTS

| | | | |
|---|---|---|---|
| 2,270,723 | 1/1942 | Boehne | 200/144 C |
| 2,366,485 | 12/1944 | Brink et al. | 200/144 C |
| 2,704,381 | 3/1955 | Nelson | 200/144 C |
| 3,735,074 | 5/1973 | Frind et al. | 200/149 A |
| 3,814,620 | 6/1974 | Bailey et al. | 200/144 C |

*Primary Examiner*—Robert S. Macon
*Attorney, Agent, or Firm*—William Freedman

[57] ABSTRACT

This arc chute comprises an arc-confining portion of an electric insulating material comprising the heat and pressure reacted thermoset product of a mixture of chrysotile asbestos, orthophosphoric acid, and silica sand. The silica sand is present in the mixture in an amount of between 23.5 and 30.5 percent by weight of the mixture. The insulating material prior to operation of the arc chute has a surface layer formed by subjecting the pre-existing surface of the material to arc-plasma flame treatment that converts the material at said surface to an amorphous fused material, the major proportion of which is silica.

10 Claims, 5 Drawing Figures

CIRCUIT BREAKER ARC CHUTE HAVING COMPONENTS OF REFRACTORY INORGANIC MATERIAL WITH SURFACES OF AN AMORPHOUS FUSED MATERIAL, A MAJOR PROPORTION OF WHICH IS SILICA, AND METHOD FOR MAKING SAME

BACKGROUND

This invention relates to an arc chute for an electric circuit breaker and, more particularly, relates to an arc chute of a refractory inorganic material having surface portions of an amorphous fused material, a major proportion of which is silica. The invention also relates to a method of making such an arc chute.

In U.S. Pat. No. 3,735,074—Frind, Korte, and Zlupko it is pointed out that exceptional current-interrupting performance can be obtained with an arc chute of a refractory inorganic material having a surface of an amorphous, fused material principally of silica. In U.S. Pat. No. 3,814,620—Bailey et al. there is disclosed a method for producing such a surface which involves arc-plasma spraying molten silica particles onto a substrate of refractory inorganic material. While such spraying can be performed relatively inexpensively, some expense and considerable care are required for its proper performance; and it would be highly desirable if the amorphous, fused principally-silica surface portion could be obtained without the need for such spraying.

Accordingly, an object of our invention is to provide an arc chute material that comprises a base of refractory inorganic material and a surface portion of an amorphous fused material, a major proportion of which is silica, produced by a process which is less expensive and easier to practice than arc-plasma spraying.

The sprayed-on, fused principally-silica coating of the above patents has exceptional durability even when repetitively exposed to high current arcs. But if for some reason this coating should be burned off or otherwise removed from a particular region of the arc chute, then the underlying substrate in this region will thereafter be directly exposed to arcs; and if the substrate is of the conventional material typically used heretofore, there will no longer be a surface principally of silica in this region to impart its desired arc-interrupting properties.

Accordingly, another object of our invention is to provide an arc chute material, initially surfaced with fused principally silica material, that is capable of reacting with an electric arc to produce a replacement surface of a fused principally-silica material if, when, and where the initial surface is removed from any portion of the arc chute.

A material that is especially suited for serving as a base for the fused principally-silica coating of the above-cited patents is phospho-asbestos material made from a mixture of chrysotile asbestos fibres, orthophosphoric acid, and a filler of zircon. The properties of this material, without the zircon filler, are described in detail in U.S. Pat. No. 2,366,485—Brink and Arone, assigned to the assignee of the present invention. The zircon filler, which is typically added in an amount of about 50 percent by weight of the mixture, improves the properties of the material by imparting added mechanical strength and refractoriness, as well as reducing the gassiness of the material when exposed to an arc. This zircon-filled phospho-asbestos material has been widely used for arc chutes, both with a fused silica coating and without such coating. Zircon-filled phospho-asbestos material with lower percentages of zircon filler has also been used, but this material has shown significantly inferior current-interrupting ability as compared to the aforesaid 50 percent zircon material.

A disadvantage of the zircon-filled phospho-asbestos material, especially that of the aforesaid 50% zircon material, is that it is quite expensive and quite heavy, due in large measure to the relatively high cost and the relatively high specific gravity of zircon.

Another object of our invention is to provide a phospho-asbestos material containing an inexpensive and relatively light-weight filler, which material when used in a circuit-breaker arc chute is capable of providing current-interrupting performance at least substantially equal to that of zircon-filled phospho-asbestos material made from a mixture containing 50 percent zircon by weight.

Another object is to provide a high quality phospho-asbestos material that includes silica sand as its principal filler.

SUMMARY

In carrying out our invention in one form, we make an arc-confining portion of the arc chute of an electric insulating material comprising the heat and pressure reacted thermoset product of a mixture of chrysotile asbestos fibres, orthophosphoric acid, and silica sand. The silica sand is present in the mixture in an amount of between 23.5 and 30.5 percent by weight of the mixture. The phosphoric acid is present in the mixture in an amount of about one-half part by weight to each part by weight of asbestos fibre. The asbestos fibre in the mixture is characterized by a fibre length sufficiently great as to preclude substantial warping of the arc chute portion when cooled to room temperature following baking. The insulating material prior to operation of the arc chute has a surface layer formed by subjecting the preexisting surface of said material to arc-plasma flame treatment that converts the material at said surface to an amorphous fused material, the major proportion of which, by weight, is silica.

DETAILED DESCRIPTION OF PREFERRED EMBODIMENT

Figure 1:
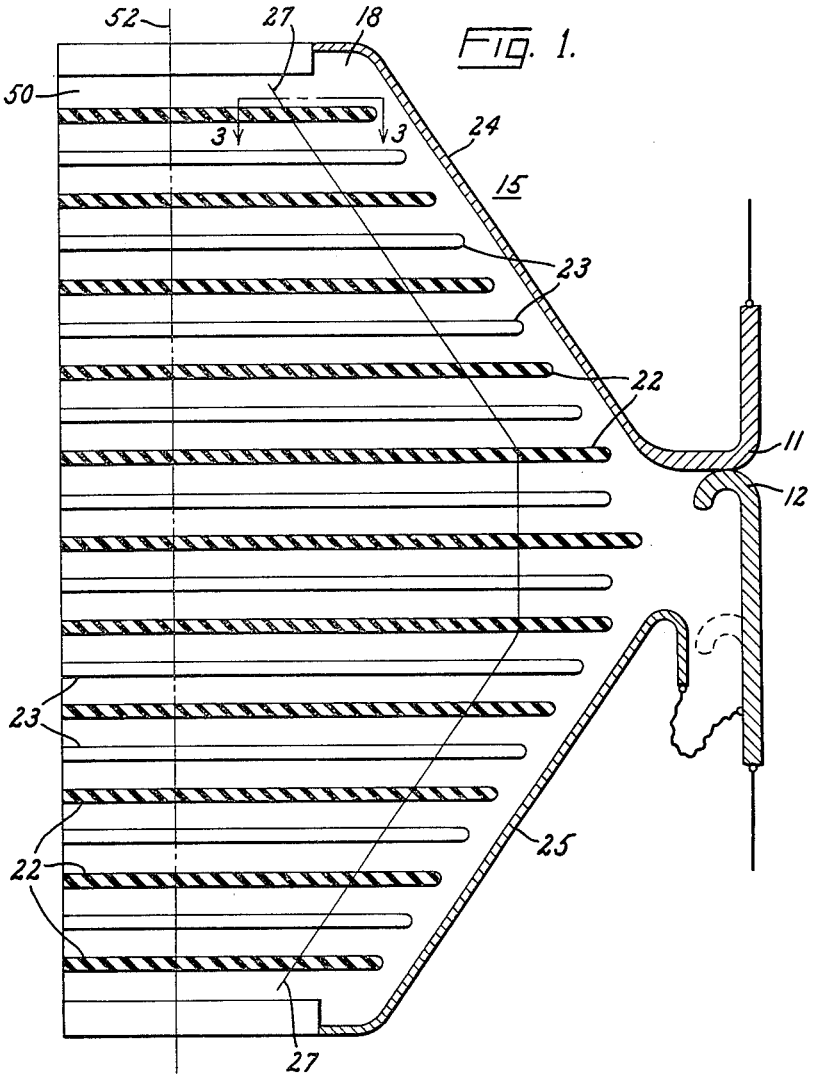
FIG. 1 is a sectional view of a circuit breaker comprising an arc chute embodying one form of our invention. The arc chute is shown in simplified form.

Referring now to FIG. 1, the electric circuit breaker shown therein comprises a stationary contact 11 and a movable contact 12 that is vertically movable into and out of engagement with the stationary contact. When the movable contact is driven downwardly from its solid-line closed position of FIG. 1 into a dotted-line open position, an electric arc is established between the two contacts 11 and 12. This arc is driven into an arc chute 15, where it is lengthened, cooled, and extinguished.

Figure 2:
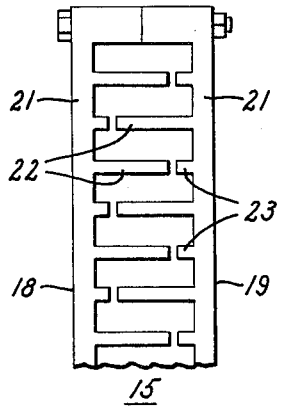
FIG. 2 is an end view of the arc chute of FIG. 1.
Figure 3:
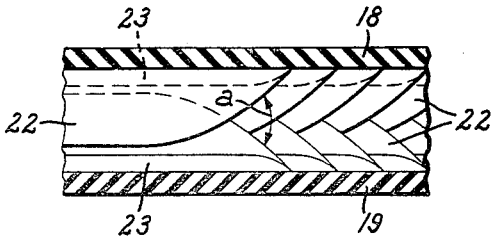
FIG. 3 is a sectional view taken along the line 3—3 of FIG. 1.

The arc chute 15 comprises a pair of sidewalls 18 and 19 constructed of an arc-resistant insulating material soon to be described in greater detail. As shown in FIG. 2, these sidewalls are suitably clamped together to provide a hollow structure capable of confining the arc as it moves into the chute. Each sidewall includes a side member 21 and a plurality of main fins 22 projecting therefrom toward the side member of the other sidewall and arranged to interleave with the corresponding projecting main fins of the other sidewall, thereby forming a sinuous or zig-zag passage as viewed from the entrance end or exhaust end of the chute. The view from the latter end is illustrated in FIG. 2. As shown in FIGS. 2 and 3, each side wall also includes auxiliary fins or ribs 23 located between its own main fins 22 and aligned with the main fins 22 of the other sidewall.

Referring to FIG. 2, the forward edges of the interleaving fins 22 taper toward the arc-initiation region at the right hand end of the chute. The tapering edges of each adjoining pair of fins 22 intersect as viewed in FIG. 2 to form an entrance angle such as *a* at the entrance to the zig-zag passage between the fins. The vertexes of these entrance angles all lie on a curvilinear line 27 (FIG. 1) which constitutes their locus. The region of the arc chute immediately adjacent this line 27 we refer to hereinafter as the vertex region of the arc chute.

For promoting movement of the arc into the arc chute, a pair of conductive arc runners 24 and 25 are provided along opposite edges of the chute. As shown in FIG. 1, these runners extend transversely of the axis of any arc formed between the contacts 11 and 12 and in divergent relationship with respect to each other from the arc-initiation region adjacent the separable contacts. When an arc is formed between the contacts during interruption, its terminals quickly transfer to the metal runners 24 and 25 and move to the left into the chute. As the arc moves into the chute, it encounters the edges of the fins 22 and is forced into a zig-zag configuration as it bends around the overlapping edges of the fins 22 while moving further into the chute. This elongation of the arc and the cooling that results therefrom are important factors contributing to successful circuit interruption.

Many of the details of the circuit breaker and its arc chute have been omitted in order to simplify the present application, but these details can be conventional and reference may be had to one of the following patents if more information is desired as to these details: U.S. Pat. No. 2,709,735—Phillips et al.; U.S. Pat. No. 3,735,074—Frind et al.; U.S. Pat. No. 3,801,760—Korte; all assigned to the assignee of the present invention.

As pointed out in the introductory portion of this specification, a material widely used for the sidewalls 18 and 19 of an arc chute such as 15 is a material comprising the heat and pressure reacted thermoset product of a mixture of asbestos fibres, orthophosphoric acid, and a zircon filler present in an amount of 50 percent by weight of the total mixture. While this material has good mechanical and circuit-interrupting properties, it is subject to the disadvantage that it is relatively expensive and relatively heavy, due in large measure to the presence of the high-density zircon filler. We have constructed our arc chute sidewalls of a material that has mechanical and circuit-interrupting properties comparable to those of this zircon-filled material but largely free from the above-described disadvantages.

Our material is the heat and pressure reacted thermoset product of a mixture of asbestos fibres, orthophosphoric acid, and silica sand. The proportions of the ingredients are referred to more specifically hereinafter. The asbestos fibres used in the mixture are of chrysotile asbestos and, in a preferred form of the invention, are 5R grade fibres under the Canadian Standard Grade Designation for chrysotile asbestos fibres. The orthophosphoric acid has a concentration exceeding 60 percent and preferably about 75 percent. In a preferred form of the invention, the silica sand is 325 mesh sand. About 70% by weight of such sand consists of particles having a size of between 10 and 50 microns.

In preparing a molding composition from these ingredients, we first mix the asbestos and the silica sand while dry for 30 to 60 seconds. We then add the liquid orthophosphoric acid in an amount of about one-half part by weight to each part by weight of asbestos fibres and mix these ingredients for about 14 to 17 minutes in a suitable water-cooled mixer. The resulting mixture is then used to fill hot molds of an appropriate configuration soon to be described. The filled molds are subjected to a pressure of about 4,000 p.s.i. and a temperature of about 285° F. Under this pressure and temperature the asbestos and the phosphoric acid react and cure. The molded piece is extracted after curing for the proper time when it has cooled to a temperature of about 125° F, the usual period being about 14 to 30 minutes depending upon the size and thickness of the molded piece.

Figure 4:
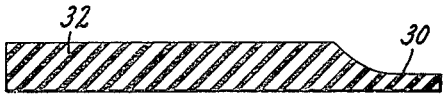
FIG. 4 shows a molded blank or slab from which one sidewall of the arc chute of FIG. 1 is fabricated.

The molded piece is preferably in the form of a slab of generally the cross-sectional shape depicted in FIG. 4. This slab includes a thinner section 30 and a thicker section 32. After the slab 30, 32 has been extracted from the mold, a plurality of grooves are milled into the thicker portion 32 at spaced locations to form the main fins 22 and the auxiliary fins 23. The machined article is then subjected to a baking operation for the purpose of further removing water from the molded product and accelerating the cure or hardening reaction between the asbestos and the phosphoric acid. Such baking is usually carried out at temperatures from about 250° F to 700° F, preferably about 600° F, for a period of time ranging from 8 to 12 hours.

Figure 5:
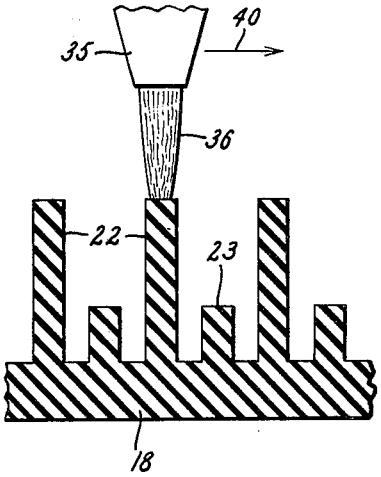
FIG. 5 shows a step in the process of making a sidewall of the arc chute.

After this baking operation has been completed, the finned surface of the sidewall is subjected to a flame treatment operation performed with a plasma-arc torch 35 as shown in FIG. 5. Since such torches are conventional, no details of the torch itself are shown. In general, such a torch comprises spaced electrodes within the torch between which a high-current electric arc is formed. A suitable gas is passed through the region of the arc to form a stream 36 of extremely hot arc plasma, which is expelled from the torch through a suitable nozzle. As shown in FIG. 5, the arc plasma stream is projected against the finned surface of the sidewall 18. During this flame treatment, the torch 35 is moved perpendicularly to the longitudinal dimension of the fins, as indicated by the arrow 40 in FIG. 5. Each pass of the torch across the fins follows a path parallel to and closely adjacent that of the preceding paths so that the heat-affected zone from each pass slightly overlaps that resulting from the preceding pass. The overall pattern of the torch is similar to that depicted in FIG. 2 of U.S. Pat. No. 3,814,620—Bailey et al. This perpendicular motion of the torch reduces the amount of energy supplied to any one fin during a given pass of the torch as compared to the energy that would be supplied if the torch was moved longitudinally of the fin, thus reducing the tendency of the fin to warp and crack under the heat-induced stresses. The path of the torch is shifted a short distance on each successive pass so that the entire area desired to be treated is covered. The distance between the lower end of the torch 35 and the upper end of the fins 22, as viewed in FIG. 5, is only about ¼ to ⅜ inch in the region where the fins are of maximum height. The torch is preferably maintained at a constant distance from the base of the fins.

While finned sidewalls of zircon-filled phospho-asbestos have heretofore been flame treated in a manner similar to that described in the immediately-preceding paragraph, we subject our sidewalls to a much more intense flame-treatment process than used with the zircon-filled material. In a preferred form of the invention, we subject the surfaces of the sidewall that face upwardly in FIG. 5 to an arc plasma flame having a temperature at the mouth of the nozzle of about 11,000° F as compared to the approximately 9000° F flame typically used with the zircon-filled material. Moreover, we decrease the spacing between successive passes of the torch by one third as compared to the prior process. When sidewalls of silica-filled material were flame treated with the same temperature flame as heretofore used for the zircon-filled material for the same exposure time as heretofore used with the zircon-filled material, we encountered relatively poor high-current interrupting performance on the first interrupting operation of the arc chute.

The above-described higher-energy flame treatment of the surfaces of the sidewalls converts the surface material at the edges of the fins into an amorphous, fused material, a major proportion by weight of which is silica. This fused principally-silica coating does not cover the entire surface of each fin, but it does cover the upper edges of the fins as viewed in FIG. 5 and a restricted area of each fin immediately adjacent these edges.

At the rear, or exhaust, end of the arc chute, there is a region 50 where the phospho-asbestos material is not flame treated. This is illustrated in FIG. 1, where the dotted vertical line 52 represents the boundary of the flame-treated region. To the left of this line 52 the arc chute material is not flame-treated and thus does not include the fused principally-silica coating at the edge of its fins; but to the right of this line 52, the arc chute material is treated as above-described and does have the fused principally-silica coating on the edges of the fins. This uncoated region 50 is capable of evolving relatively large quantities of gases when subjected to the heat of the adjacent arc or the arcing products. These evolved gases act to block arc motion past the region of boundary line 52 and also serve to effectively cool the arcing products exhausting through the rear of the chute. A similar region substantially free of silica coating is present in the arc chute disclosed and claimed in U.S. Pat. No. 3,735,074—Frind et al.

It will be apparent from the above description that we have obtained a coating of an amorphous, fused material a major proportion of which is silica without the need for plasma-arc spraying of any silica. The hot arc-plasma stream used in the flame-treatment process is able to react with the silica already contained in the substrate material to produce the above-described fused coating principally of silica.

If for any reason our above-described principally-silica coating should be burned off or otherwise removed from any part of the arc chute that is directly exposed to a high-current arc, the arc will react with the then-bare substrate material to form a replacement coating of generally the same composition as the original principally-silica coating in the region where the original coating had been removed.

As another measure of the intensity of the arc-plasma flame treatment which produces the fused principally-silica coating, reference may be had to the thickness of the coating. At the tongue of the arc chute, which is the region ahead of the vertex 27 and closest to the contacts, this coating is about 8 mils in thickness. At the vertex 27, the coating thickness is about 6 to 7 mils; and along a vertical line one inch to the right of reference line 52, the coating thickness is about 5 mils. Substantially lower thicknesses, typically 50 to 60 percent or less of those described above, are produced when the silica-filled material is subjected to the above-described lower-intensity plasma flame treatment typically used heretofore with the zircon-filled material.

Returning now to the mixture that is used for preparing the molding composition, the asbestos fibres in the mixture should be characterized by a length at least substantially as great as that characterizing 6D grade asbestos fibre. Preferably, an even greater length fibre, such as that characteristic of 5R grade asbestos fibre is used. These grade designations are the Canadian Standard Grade Designations for chrysotile asbestos fibre lengths. When substantially shorter fibres are used, the arc chute will warp excessively after the above-described baking operation.

The amount of silica sand that is used in the mixture should be between 23.5 and 30.5 percent by weight of the mixture. A preferred percentage is approximately midway between these extremes, i.e., about 27 percent. When the silica sand content exceeds about 30.5 percent, the mechanical strength of the material is too low and its porosity is too high for our arc chute application. When the silica sand content is less than about 23.5 percent, the material becomes so gassy that its current-interrupting ability is significantly impaired.

In a preferred form of the invention, we have used silica sand of 325 mesh grain size sold under the trademark SUPERSIL by Pennsylvania Glass Sand Co. of Pittsburgh, Pa. About 70% by weight of such sand has a particle size of between 10 and 50 microns. Another satisfactory silica sand is one referred to in the trade as "fine dry sand", which is a crystalline silica about 80% by weight of which consists of particles having a size of between 53 microns and 150 microns. Sands with a coarseness intermediate these two sands also seem satisfactory.

It is especially noteworthy that silica has a specific gravity of roughly one-half that of zircon, and this very substantially reduces the weight of our arc chute. As an example, the sidewalls of our arc chute typically weigh 25 percent less than those of comparable arc chutes made of the 50 percent zircon-filler phospho-asbestos material referred to hereinabove. Moreover, silica sand is much less expensive than zircon.

The mechanical strength of the preferred silica-filled phospho-asbestos material described hereinabove seems to be about the same as that of the 50% zircon-filled phospho-asbestos material referred to hereinabove. Each of these materials has a flexure strength of about 5,000–6,000 p.s.i. The thermal shock resistance of the silica-filled phospho-asbestos material is comparable to that of the zircon-filled phospho-asbestos material. This high thermal shock resistance enables the silica-filled phospho-asbestos material to be plasma flame treated, as above described, or to be coated with a metallic oxide by arc-plasma spraying, as in the aforesaid U.S. Pat. No. 3,814,620—Bailey et al., without significant damage. Moreover, the silica-filled material is easier to machine than the 50% zircon-filled material, enabling the cutters used for machining to have longer lives.

As compared to the silica-sprayed phospho-asbestos material disclosed in U.S. Pat. No. 3,735,074—Frind et al and referred to in the introductory portion of this specification, our material is distinctly advantageous in that it does not require for its manufacture any spraying of solid material. While silica is a comparatively inexpensive material to arc-plasma spray, the expenses involved are, nevertheless, significant, and also considerable care must be exercised in order to properly perform the spraying process to obtain a fused silica coating of the desired properties. The flame-treating process that we employ is considerably easier to control inasmuch as no spray material is utilized and there is no need to control the rate of feed, the particle size, and other parameters associated with the spray material.

In a typical arc chute embodying my invention, the main fins 22 are 1¼ inches in height in their region of maximum height, ⅛ inch in thickness, and ⅜ inch apart. The auxiliary fins 23 are the same thickness but only about ¼ inch in height in their region of maximum height. As viewed in FIG. 1, this arc chute is 20¼ inches in height and 15½ inches from the region of the contacts to the back of the chute. These dimensions are given by way of example and not limitation.

While we have shown and described a particular embodiment of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. An arc chute for an electric circuit breaker comprising a portion for confining the arc formed upon circuit-breaker opening, a. said portion being of an electric insulating material comprising the heat and pressure reacted thermoset product of a mixture of chrysotile asbestos fibres, orthophosphoric acid, and silica sand;

b. said silica sand being present in said mixture in an amount of between 23.5 and 30.5 precent by weight of the mixture;

c. said phosphoric acid being present in said mixture in an amount of about ½ part by weight to each part by weight of asbestos fibres; and d. said asbestos fibre in the mixture being characterized by a fibre length sufficiently great as to preclude substantial warping of said arc-chute portion when cooled to room temperature following baking, and e. said insulating material prior to operation of said arc chute having a surface layer formed by subjecting the pre-existing surface of said material to arc-plasma flame treatment that converts the material at said surface to an amorphous fused material, the major proportion of which by weight is silica.

2. The arc chute of claim 1 in which said asbestos fibres in said mixture are characterized by a fibre length at least substantially as great as that characterizing asbestos fibre having a 6D grade designation under the Canadian Standard grade designations for asbestos fibre.

3. An arc chute for an alternating current electric circuit breaker into which an arc is adapted to be driven for the purpose of extinguishing the arc, comprising:

a. means defining an arc-initiation region in which the arc is initiated during an interrupting operation, b. a pair of spaced-apart side members of insulating material extending generally parallel to the path followed by said arc as it moves into said chute from said arc-initiation region, c. spaced-apart plates of insulating material on said side member, extending transversely of said side members, and having edges for engaging said arc as it moves into said chute, d. the insulating material of said plates and side members comprising the heat and pressure reacted thermoset product of a mixture of chrysotile asbestos fibres, orthophosphoric acid, and silica sand, e. said silica sand being present in said mixture in an amount of between 23.5 and 30.5 percent by weight of the mixture, f. said phosphoric acid being present in said mixture in an amount of about ½ part by weight to each part by weight of asbestos fibres, g. said asbestos fibre in the mixture being characterized by a fibre length sufficiently great as to preclude substantial warping of said side members and said plates when said side members and plates are cooled to room temperature following baking, h. said edges of said plates having surface layers formed prior to operation of said arc chute by subjecting the pre-existing surfaces of said edges to arc-plasma flame treatment that converts the insulating material at said edges to layers of amorphous fused material, the major proportion of which by weight is silica.

4. The arc chute of claim 3 in which:

a. both of said side members have integral fins projecting therefrom and constituting said plates, and b. the fins on one side member interleave with the fins on the other side member and have their edges spaced from the other side member.

5. The arc chute of claim 3 in which there is a vertex region where the edges of said plates interfere with penetration of the arc further into the arc chute, said surface layers at the edges of said plates in said vertex region being characterized by a thickness of greater than 5 mils.

6. The arc chute of claim 5 in which:

a. both of said side members have integral fins projecting therefrom and constituting said plates, and b. the fins on one side member interleave with the fins on the other side member and having their edges spaced from the other side member.

7. The arc of claim 4 in which each of said side members has portions aligned with the fins of the other side member, said aligned portions having surface layers formed prior to operation of said arc chute by subjecting the pre-existing surfaces of said aligned portions to arc-plasma flame treatment that converts the material at said surfaces to layers of amorphous fused material, the major proportion of which by weight is silica.

8. The arc chute of claim 4 in which said plates have surfaces extending transversely of said side members, said transversely-extending surfaces having portions adjacent said side members that are substantially free of said amorphous, fused principally-silica layer.

9. A method of making a portion of an arc chute for an electric circuit breaker comprising:

a. preparing a mixture of (i) chrysotile asbestos fibres, (ii) orthophosphoric acid, and (iii) silica sand, in which the silica sand is present in an amount of 23.5 to 30.5 percent by weight of the mixture and the orthophosphoric acid is present in an amount of about one-half part by weight to each part by weight of said asbestos fibres, b. molding said mixture under heat and pressure to form a slab which is the thermoset reaction product of said mixture, c. machining one surface of said slab to form an arc chute side member having spaced fins projecting therefrom, d. baking said machined slab to remove moisture therefrom, and e. arc plasma flame treating the machined surface of the slab with a flame of sufficient energy to convert the material at the edges of said fins into surface layers that are of an amorphous, fused material, the major proportion of which by weight is silica.

10. The method of claim 9 in which said flame treating is performed with an arc plasma torch having a nozzle through which arc plasma is projected onto said machined surface while the temperature at the mouth of said nozzle is maintained at the temperature of at least about 11,000° F.

* * * * *